United States Patent [19]

Kayanuma

[11] 4,351,296

[45] Sep. 28, 1982

[54] APPARATUS FOR CONTROLLING DECELERATION OF AN INTERNAL COMBUSTION ENGINE

[75] Inventor: Nobuaki Kayanuma, Susono, Japan

[73] Assignee: Toyota Jidosha Kogyo Kabushiki Kaisha, Toyota, Japan

[21] Appl. No.: 150,629

[22] Filed: May 16, 1980

[30] Foreign Application Priority Data

May 30, 1979 [JP] Japan ..... 54-71747[U]

[51] Int. Cl.[3] ..... F02P 5/04

[52] U.S. Cl. ..... 123/328; 123/329; 123/409

[58] Field of Search ..... 123/328, 329, 407, 408, 123/409

[56] References Cited

U.S. PATENT DOCUMENTS

| | | | |
|---|---|---|---|
| 3,027,884 | 4/1962 | Bale, Jr. et al. | 123/329 X |
| 3,547,089 | 12/1970 | Pierlot | 123/408 |
| 3,603,298 | 9/1971 | Toda et al. | 123/329 |
| 3,626,914 | 12/1971 | Brownson et al. | 123/407 |
| 4,051,823 | 10/1977 | Mogi et al. | 123/407 |
| 4,059,088 | 11/1977 | Tateno et al. | 123/328 |

*Primary Examiner*—Tony M. Argenbright
*Attorney, Agent, or Firm*—Kenyon & Kenyon

[57] ABSTRACT

A throttle positioning system is provided for holding a throttle valve at a position slightly more open than at the normal idling position, and an idle vacuum advance mechanism is provided for advancing the ignition timing when the throttle valve is at a position less than a predetermined opening degree. The idle vacuum advance mechanism is disabled from advancing the ignition timing when the throttle positioning system is operating.

3 Claims, 2 Drawing Figures

APPARATUS FOR CONTROLLING DECELERATION OF AN INTERNAL COMBUSTION ENGINE

BACKGROUND OF THE INVENTION

The present invention relates to a deceleration control apparatus of an internal combustion engine. More particularly, the present invention relates to a deceleration control apparatus of an internal combustion engine having a vacuum advance mechanism which advances the ignition timing of the engine during idling.

In a conventional internal combustion engine, when the throttle valve closes to its idle position, the air-fuel mixture supplied to a combustion chamber becomes rich and will not burn completely. As a result, large amounts of hydrocarbon (HC) are emitted from the engine at that time.

A deceleration control device, for example, a throttle positioner system, which holds the throttle valve open slightly more than at the idle position when the engine is decelerating, causes the air-fuel mixture to become leaner, so that complete combustion of the mixture takes place. This device is known and utilized for reducing HC emission of various internal combustion engines.

In these various engines having a deceleration control device, some engines have an idle vacuum advance device, which operates only during a specific operating condition where the degree of the opening of the throttle valve is less than a predetermined value, and advances the ignition timing of the engine in accordance with the vacuum level in an intake passage downstream of the throttle valve, so as to reduce fuel consumption when the engine is idling.

However, such engines having both a deceleration control device and an idle vacuum advance device have other problems. During the decelerating operation, since the idle vacuum advance device operates and thus causes the ignition timing to advance considerably, HC emission increases in large quantities at that time in spite of the operation of the deceleration control device. Furthermore, since the ignition timing advances during deceleration, this reduces the effect of the engine braking operation.

SUMMARY OF THE INVENTION

It is, therefore, an object of the present invention to provide a deceleration control apparatus which can reduce HC emission during deceleration and which can improve the engine braking effect during deceleration, in spite of the ignition timing advance that is provided during idling.

According to the present invention, a deceleration control apparatus for an internal combustion engine comprises: a throttle positioning means for maintaining the degree of the opening of a throttle valve at a predetermined degree which is larger than the degree of the opening during idling, when the engine is decelerating, and a vacuum advance means, responding to a vacuum level in an intake passage of the engine downstream from the throttle valve, for advancing the ignition timing of the engine. The vacuum advance means operates only when the engine is at a specific operating condition where the degree of the opening of the throttle valve is less than the above-mentioned predetermined degree, and is disabled when the throttle positioning means is actuated to hold the throttle valve open at the above-mentioned predetermined degree.

The above and other related objects and features of the present invention will be apparent from the following description of the present invention with reference to the accompanying drawings, as well as the appended claims.

DETAILED DESCRIPTION OF THE PREFERRED EMBODIMENTS

Figure 1:
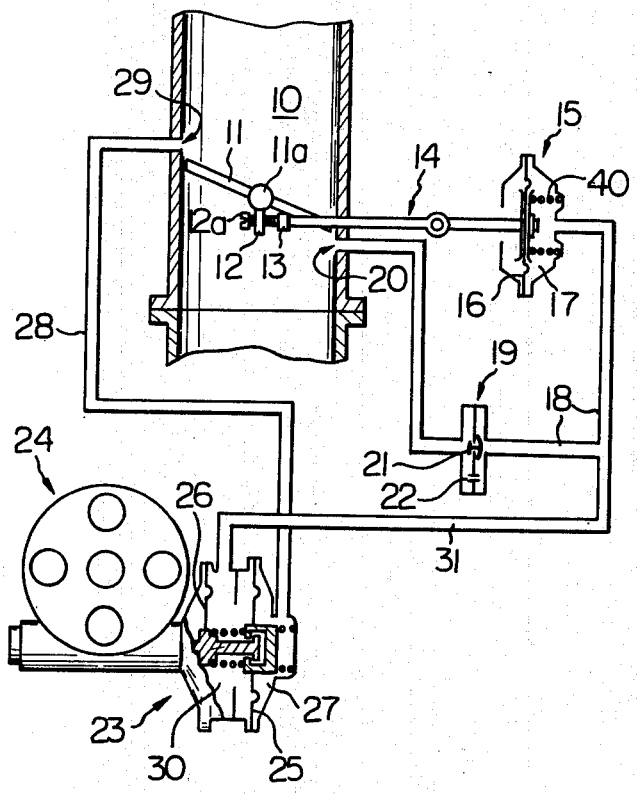
FIG. 1 is a schematic view showing a first embodiment of the present invention.

Referring to FIG. 1, which shows a first embodiment of the present invention, reference numeral 10 denotes an intake passage of an internal combustion engine, and 11 denotes a throttle valve disposed in the intake passage 10.

A lever 12 with an adjusting screw **12*a* is attached to a valve axis 11*a* of the throttle valve 11, and rotates together with the throttle valve 11. A stopper 13 which is capable of coming into contact with the adjusting screw 12*a*, so as to stop the movement of the throttle valve 11, is connected to a diaphragm 16 of a diaphragm actuator 15 via a link mechanism. When the intake vacuum is introduced into a diaphragm chamber 17 partitioned by the diaphragm 16, the diaphragm 16 moves against the tension of a spring 40 and thus pulls the link mechanism 14. Therefore, at that time, the lever 12 does not come into contact with the stopper 13, and thus the throttle valve 11 can be closed in its idle position. Contrary to this, when atomospheric pressure is introduced into the diaphragm chamber 17, the diaphragm 16 is pushed back by the tension of the spring 40 and causes the stopper 13 to move into the set position. Therefore, the lever 12 comes into contact with the stopper 13, and the movement of the throttle valve is stopped before the throttle valve 11 is closed in the idle position. Namely, in this case, the throttle valve 11** is held at a set position, slightly more open than the idle position.

The diaphragm chamber 17 communicates with a port 20 via a conduit 18 and also a vacuum transmitting valve 19. The port 20 opens to the intake passage 10 at a position located downstream from the throttle valve 11 when the throttle valve 11 is at the idle position or at the above-mentioned set position slightly more open than the idle position, and at a position located upstream from the throttle valve 11 when the throttle valve 11 is open more than the above-mentioned set position.

The vacuum transmitting valve 19 is provided with a check valve 21 and an orifice 22. When atmospheric pressure from the port 20 acts on the vacuum transmitting valve 19, the check valve 21 opens to allow the atmospheric pressure to quickly transmit into the conduit 18. Contrary to this, when intake vacuum from the port 20 acts on the vacuum transmitting valve 19, the check valve 21 closes, and thus the intake vacuum is slowly transmitted into the conduit 18 by passing only through the orifice 22.

A vacuum advance mechanism 23 attached to a distributor 24 of the engine is provided with two diaphragms, namely, a main diaphragm 25 and a sub-diaphragm 26, having different vacuum advance characteristics from each other. A main diaphragm chamber 27 partitioned by the main-diaphragm 25 communicates with an advance port 29 via a conduit 28. The advance port 29 opens to the intake passage 10 at a position located upstream from the throttle valve 11 when the throttle valve 11 is at the idle position or at the set position which is caused by the operation both of the lever 12 and the stopper 13, and also at a position located downstream from the throttle valve 11 when the throttle valve 11 opens more than the set position. Therefore, when the throttle valve 11 is positioned upstream from the advance port 29, in other words, when the engine is operating at medium and high speed conditions, the main diaphragm 25 moves in accordance with the vacuum developed at the advance port 29, and thus the ignition timing of the engine is controlled by the main-diaphragm 25 to advance in accordance with the intake vacuum at that time.

A sub-diaphragm chamber 30 partitioned by both the main-diaphragm 25 and sub-diaphragm 26 communicates with the conduit 18 and, therefore, with the diaphragm chamber 17 of the diaphragm actuator 15, via a conduit 31. Only when the intake vacuum is introduced into the sub-diaphragm chamber 30 via the conduit 31, does the sub-diaphragm 26 act to advance the ignition timing of the engine.

Hereinafter, the operation of the first embodiment will be described. At medium and high speed operations, since the port 20 is located upstream from the position of the throttle valve 11, atmospheric pressure is applied to the diaphragm chamber 17 of the diaphragm actuator 15 and to the sub-diaphragm chamber 30 of the vacuum advance mechanism 23. Therefore, the diaphragm 16 is pushed back by the spring 40, causing the stopper 13 to move to the set position. Furthermore, at that time, the vacuum advance control of the sub-diaphragm 26 is stopped.

When the operating condition of the engine changes from the medium and high speeds to the deceleration mode, in other words, when the throttle valve is closed while under medium and high speed conditions, since the lever 12 comes into contact with the stopper 13, the throttle valve 11 stops at a position slightly more open than at the full closed idle position. Therefore, neither will the vacuum in the intake passage 10 positioned downstream from the throttle valve 11 rapidly increase, nor will the amount of intake air considerably decrease. As a result, incomplete combustion of the air-fuel mixture can be prevented from occurring, and thus HC emission can be reduced. Furthermore, at this time, since atmospheric pressure is introduced into the sub-diaphragm chamber 30, thus stopping the ignition advance control by the sub-diaphragm 26, HC emission can be more effectively reduced, and also the engine braking effect can be improved.

When the throttle valve 11 is held at a position slightly more open than the idle position, the port 20 is located downstream from the throttle valve 11, and thus intake vacuum is applied to the vacuum transmitting valve 19. However, in this case, since the check valve 21 closes, and thus the intake vacuum is transmitted through the orifice 22 to the conduit 18 very slowly, the diaphragm chamber 17 and the sub-diaphragm chamber 30 are maintained at atmospheric pressure for a certain time period, for example, for 2 to 15 seconds. Therefore, during deceleration, the throttle valve 11 is held at a position slightly more open than the idle position, and the ignition advance control by the sub-diaphragm 26 is stopped. As a result, HC emission can be effectively reduced and an improved engine braking effect can be obtained during this time.

Thereafter, namely, after the above-mentioned time period has passed from the start of deceleration, the intake vacuum is applied to the diaphragm chamber 17 and also to the sub-diaphragm chamber 30. Therefore, at that time, the diaphragm 16 moves to the right, and thus the stopper 13 is pulled so as to cause the throttle valve 11 to fully close. Consequently, the engine idles at a specified speed, and the ignition timing is advanced by the operation of the sub-diaphragm 26.

Figure 2:
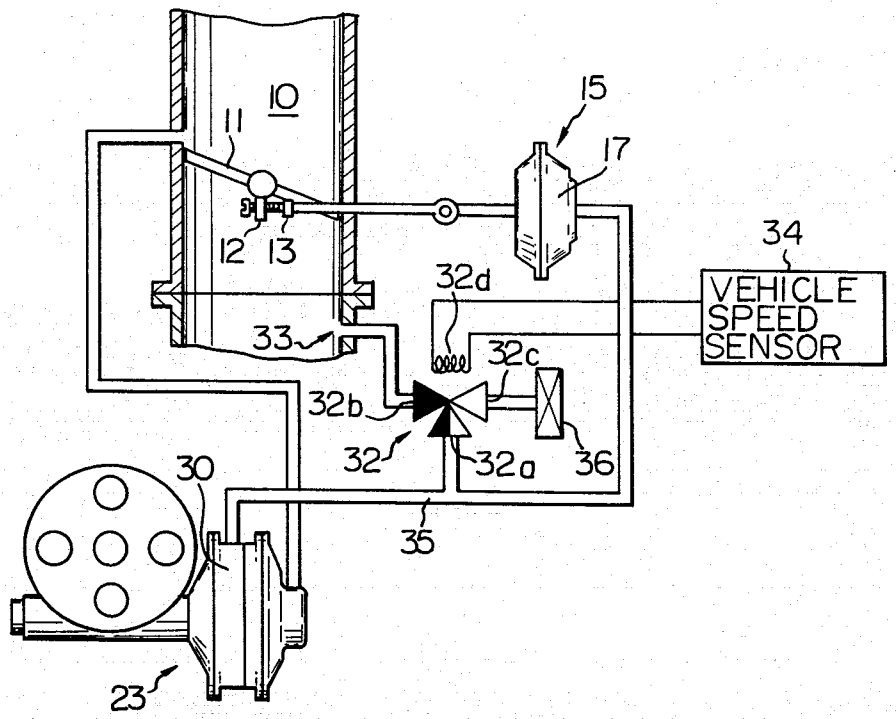
FIG. 2 is a schematic view showing a second embodiment of the present invention.

FIG. 2 shows a second embodiment of the present invention. The construction of this second embodiment is the same as that of the first embodiment of FIG. 1 except that a three-port electromagnetic valve 32, a port 33 and a vehicle speed sensor 34 are provided, instead of the vacuum transmitting valve 19 and the port 20 which are provided in the first embodiment.

Referring to FIG. 2, a first port **32*a* of the electromagnetic valve 32 communicates with both the diaphragm chamber 17 of the diaphragm actuator 15 and the sub-diaphragm chamber 30 of the vacuum advance mechanism 23 via a conduit 35. A second port 32*b* of the electromagnetic valve 32 communicates with the port 33, which opens to the intake passage 10 at a position located always downstream from the throttle valve 11. A third port 32*c* of the electromagnetic valve 32** opens to the atmosphere via an air cleaner.

When a signal which indicates that the vehicle speed is higher than a predetermined speed is applied to an exciting coil **32*d* of the valve 32 from the vehicle speed sensor 34, the valve operates so as to communicate the first port 32*a* with the third port 32*c*. Contrary to this, when a signal indicating that the vehicle speed is equal to or less than the predetermined speed is received, the valve 32 operates to communicate the first port 32*a* with the second port 32*b*. The above-mentioned predetermined speed of the vehicle speed sensor 34** will be selected to be about 10 to 30 Km/h.

Therefore, according to the present embodiment, when the engine is at medium and high speed operations or in a decelerating operation, the first port **32*a* of the valve 32 is communicated with the third port 32*c*, and thus atmospheric pressure is applied to the diaphragm chamber 17 of the diaphragm actuator 15 and to the sub-diaphragm chamber 30 of the vacuum advance mechanism 23. Contrary to this, when the engine is in an idling operation, the first port 32*a* of the valve 32 communicates with the second port 32*b*, and thus intake vacuum is applied to the diaphragm chamber 17 and to the sub-diaphragm chamber 30. As a result, at deceleration, the throttle valve 11** is held at a position slightly more open than at the idle position, and the ignition advance control is stopped. Therefore, according to the present embodiment as well as the aforementioned embodiment, HC emission during deceleration can be effectively reduced, and the engine braking effect during deceleration can be considerably improved.

As many widely different embodiments of the present invention may be constructed without departing from the spirit and scope of the present invention, it will be understood that the present invention is not limited to the specific embodiments described in this specification, except as defined in the appended claims.

I claim:

1. An apparatus for controlling deceleration of an internal combustion engine having an intake passage and a throttle valve disposed in said intake passage, said apparatus comprising:

a throttle positioning means for maintaining the opening degree of said throttle valve during deceleration at a predetermined degree larger than the degree of the opening at idling and a vacuum advance means responsive to a vacuum level in said intake passage downstream from said throttle valve for advancing the ignition timing of said engine, said vacuum advance means operating only when said engine is at a specific operating condition where the degree of the opening of said throttle valve is less than said predetermined degree, and said vacuum advance means being disabled when said throttle positioning means is actuated to keep said throttle valve open at said predetermined degree.

2. An apparatus as claimed in claim 1, wherein said internal combustion engine is installed in a vehicle, and said throttle positioning means comprises:

a stopper capable of preventing said throttle valve from closing less than said predetermined degree;

a link means;

a diaphragm actuator having a diaphragm connected to said stopper via said link means, and a control chamber for controlling a stroke of said diaphragm in response to the pressure level applied thereto; and a valve means, connected to said control chamber, for selectively communicating said control chamber either with the atmosphere or with said intake passage at a position always located downstream from said throttle valve, in response to the vehicle speed.

3. An apparatus as claimed in claim 2, wherein said vacuum advance means comprises a control chamber, communicated with said control chamber of said diaphragm actuator, for advancing the ignition timing of said engine only when the intake vacuum is applied thereto.

* * * * *